United States Patent [19]

Chang

[11] Patent Number: 5,005,386

[45] Date of Patent: Apr. 9, 1991

[54] PADLOCK WITH AN IMPROVED LOCKING STRUCTURE

[76] Inventor: Charlie Y. Chang, 293 Pei Tun Road, Taichung, Taiwan

[21] Appl. No.: 543,334

[22] Filed: Jun. 26, 1990

[51] Int. Cl.[5] ..... E05B 67/22

[52] U.S. Cl. ..... 70/39; 70/52

[58] Field of Search ..... 70/39, 26, 38 R, 38 A, 70/38 B, 38 C, 52, 51

[56] References Cited

U.S. PATENT DOCUMENTS 4,621,509 11/1986 Mizuno ..... 70/26

4,823,566 4/1989 Patton ..... 70/39

*Primary Examiner*—Robert L. Wolfe

[57] ABSTRACT

The principal purpose of this invention is to enhance locking and unlocking mechanisms of a padlock by improving structural components which allow the locking core member to be pushed into the lock body in order to trigger the locking mechanism by forcing locking plate and semi-circular sector thereof to be firmly engaged with locking notch located at the end portions of the U-shaped shackle arms. The unlocking mechanism can be triggered by simply rotating the locking core member with a key in one direction for 90 degrees, causing the locking core member and locking semi-circular sector to be disengaged. Therefore, this invention provides a padlock with improved safety features as well as convenience of ease of use.

1 Claim, 3 Drawing Sheets

PADLOCK WITH AN IMPROVED LOCKING STRUCTURE

BACKGROUND OF THE PRESENT INVENTION

There are a variety of commonly used padlocks which have structural deficiencies. Their locking and unlocking mechanisms are actuated by the rotation of a locking rod driven by a locking core member with an appropriate key, causing a U-shaped shackle to be engaged or disengaged with a cylindrical lock body. Their drawbacks include the cumbersome task of searching for a right key from a key chain and designing the locking mechanism in such a way that the shackle is forced into a locking position when a locking core member is rotated, making the padlock vulnerable to picking. Moreover, many locks require the U-shaped shackle arm to be in an appropriate reclining position in order to insert the shackle into the lock body, making the padlock prone to repetitive trial failures.

The principal object of the present invention is to provide a padlock with features of structural simplicity, speed, and safety by simply pushing the locking core member into a locking position thereof to lock padlock and by simply turning the locking core member thereof in one direction 90 degrees to unlock the padlock.

SUMMARY OF THE PRESENT INVENTION

The present invention relates to a padlock and more particularly to a padlock with an improved locking structure. The padlock of the present invention comprises a lock body, a locking plate, a receiving block, a sectored disk, an axial spring, and a locking core member.

The lock body is hollow and cylindrical with an opening at the front end thereof and has two shackle receiving holes located at appropriate positions thereof to receive shackle arms which have locking notches located at end portions thereof.

The locking plate manufactured in proportion to the inner diameter of the lock body and assembled inside the lock body, having two shackle engaging slots thereon with locking semi-circular sectors.

The receiving block, which is assembled firmly inside lock body, is semi-circular on one end thereof with a guiding groove, being circular on the other end thereof with axial pin recess therein and a semi-circular retaining groove thereon to facilitate a locking spring.

The sectored disk, assembled between the locking plate and receiving hole, has a cam sector thereon and an oval hole thereinto.

The axial spring resists the circular cross-sectional end of the receiving block.

The locking core member is capable of sliding axially inside the lock body for an appropriate distance and has, on one side thereof, a rotating bolt whose one end is firmly assembled with a locking plate and sectored disk, and on the other side thereof a locking head with a key hole thereinto and a sliding groove therein of an appropriate length.

Therefore, without using a key to drive the locking core member of a padlock, it is possible to achieve a speedy and ensuring locking mechanism by employing the integral structures mentioned above and by simply pushing the U-shaped shackle arms into shackle engaging slots of the locking plate and then pushing in the locking core member, causing the locking spring to be engaged with locking spring catch in order to refrain the locking core member from moving about and in the meantime driving the locking plate to slide axially in order to cause the locking semi-circular sectors to be in an engaging position with locking notches of shackle arms.

BRIEF DESCRIPTION OF THE DRAWINGS

For the purpose of making the objectives, material structures and features of this invention better understood, the techniques, methods and efforts used in the process of this invention are illustrated in the drawings presented below.

THE PREFERRED EMBODIMENT OF THE PRESENT INVENTION

Figure 1:
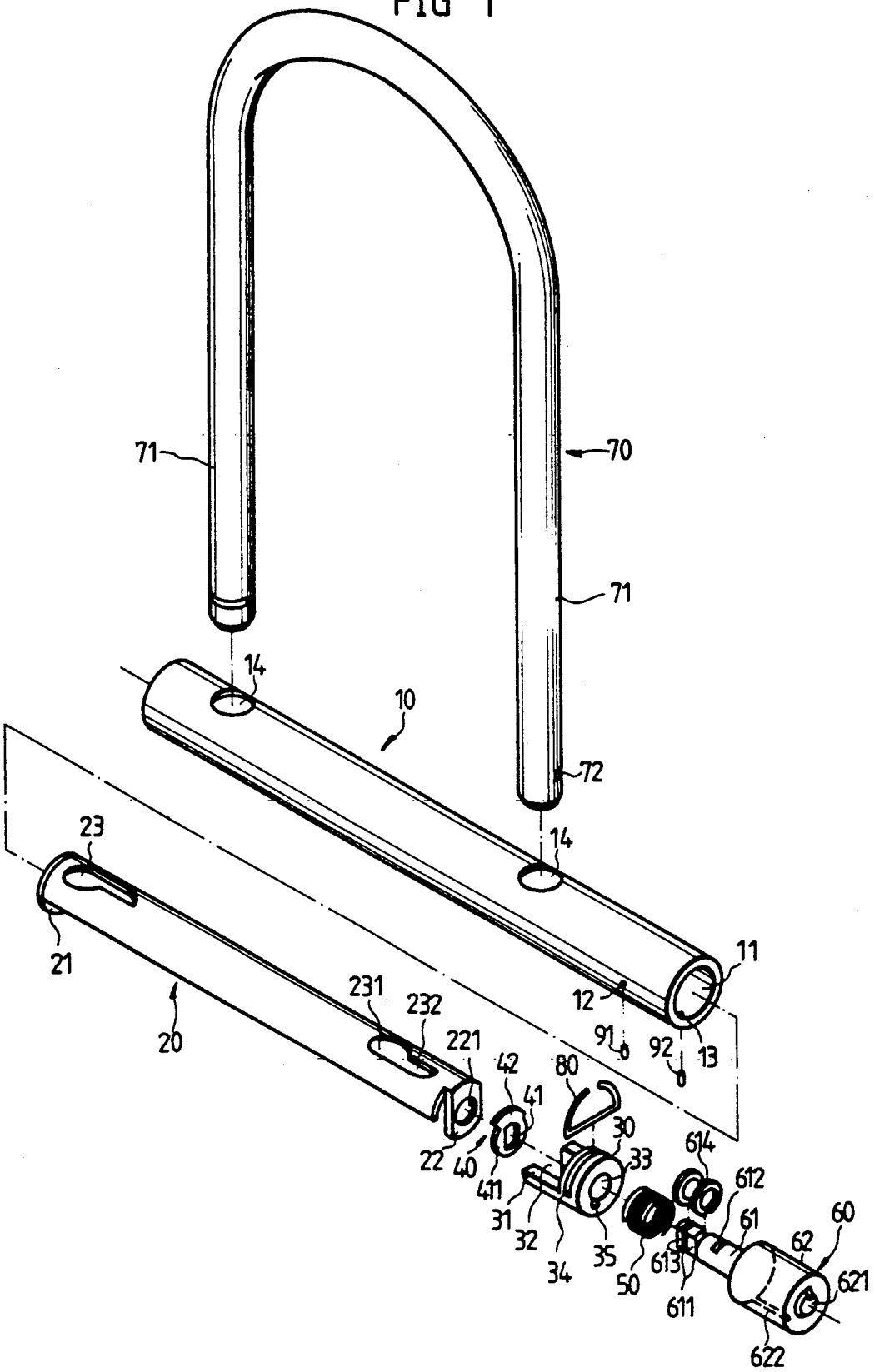
FIG. 1 is a perspective drawing which shows the dismantled parts of improved locking structural components of a padlock of this invention.

On the basis of the drawings provided, the structural components of a padlock of this invention are, in general, composed of items listed below:

A lock body 10, which is a hollow and cylindrical body structure, has a front end opening 11 with two pin holes 12 and 13 in its proximity and two shackle receiving holes 14 for receiving two shackle arms 71 of the shackle 70 having a locking notch 72 on each of two arms thereof.

A locking plate 20, a semi-circular shape in its cross-sectional view, is manufactured in such a way that it can be properly assembled inside the lock body 10. The locking plate 20 has a rear end plate 21 and an oval-shaped front end plate 22 with a thru hole 221 therein. In the proximity of both ends of the locking plate 20 are two shackle engaging slots 23 with a circular sector 231 therein and a locking semi-circular sector 232 therein located symmetrically with shackle receiving holes 14 for permitting a locking engagement between the locking plate 20 and the locking notch 72 of shackle 70.

A receiving block 30 is firmly assembled inside the lock body 10 by means of a positioning pin 91 which engages with an axial pin recess 35 of receiving block 30. On one end of receiving block 30 is a semic-circular structure with a locking spring retaining groove 34 thereon to allow a semi-circular locking spring 80 to fall through axial hole 33. On the other end of receiving block 30 are a stop face 31 and a guiding groove 32 for allowing the front end plate 22 of locking plate 20 to slide about.

A sectored disk 40 is assembled between the front end plate 22 of the locking plate 20 and the receiving block 30 and has an oval hole 41 therein symmetrically located with a thru hole 221 and an axial hole 33. In addition, the sectored disk is also composed of two oval hole flanges 411 with a cam sector 42 thereon.

An axial spring 50 is assembled between the receiving block 30 and the locking core member 60, which comprises a rotating bolt 61 symmetrically assembled with an oval hole 41 of the sectored disk 40 and having two clamp spaces 613, two retaining grooves 611 and a locking spring catch 612 thereon. Therefore, the positions of both the front end plate 22 of locking plate 20 and the sectored disk are just situated between two retaining grtooves 611. Two split collar retainers 614 are fastened to the rotating bolt 61 at the positions of two retaining grooves 611. The front end of the locking core member 60 comprises a locking head 62 which can be properly assembled into the lock body 10 at the position of the front end opening 11 and has a key hole 621 as well as a sliding groove 622 therein. A guide pin 92 is fastened through the guide pin hole 13 and is capable of sliding axially in sliding groove 622, allowing the locking core member 60 to move axially inside the lock body 10.

The brief description presented above depicts the structural and functional interrelationships among components of a padlock of this invention.

However, in order to understand and appreciate the intended effort made by this inventor on this invention, one must study further, in conjunction with drawings provided, the structural features and advantages of a padlock of this invention.

Figure 2:
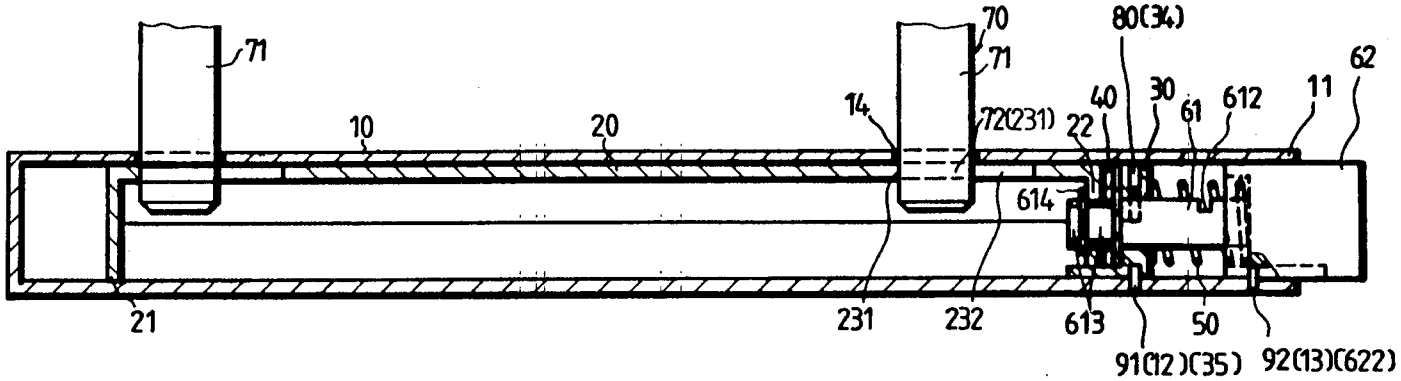
FIG. 2 shows a cross-sectional view of improved locking structural components in their respective unlocking positions.
Figure 3:
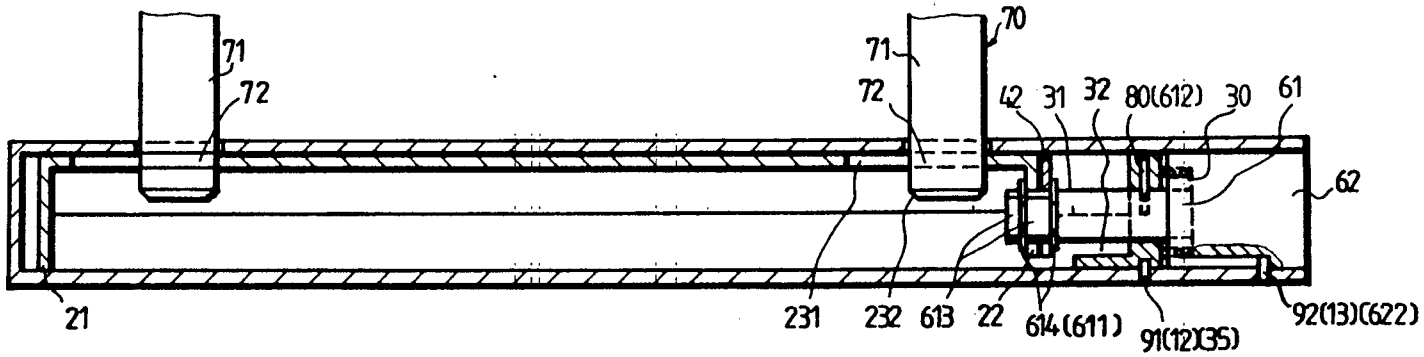
FIG. 3 shows a cross-sectional view of improved locking structural components in their respective locking positions.
Figure 5:
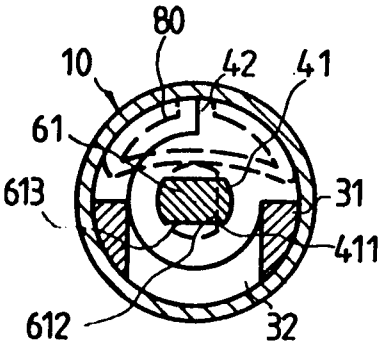
FIG. 5 shows the operational positions of receiving block and sectored disk of an unlocked padlock of this invention.
Figure 4:
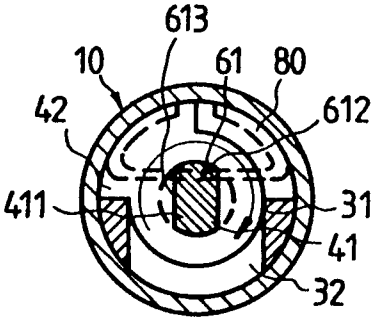
FIG. 4 shows the operational positions of receiving block and sectored disk of an locked padlock of this invention.

In reference to FIG. 2 showing a cross-sectional view of locking structural components in their respective unlocking positions, it is clearly illustrated that the receiving block 30 and the lock body 10 are attached together by means of a positioning pin 91 and that the rotating bolt 61 of the locking core member 60 is assembled through the receiving block 30, the sectored disk 40 and the front end plate 22 are refrained by split collar retainers 614, causing both sectored disk 40 and front end plate 22 to move synchronously with the rotating bolt 61. Therefore, when the locking core member 60 is pushed in as shown in FIG. 3, the rotating bolt 61 forces axial spring 50 to compress. The compressed axial spring 50 will, in turn, cause the locking plate 20 and the sectored disk 40 to move leftward, resulting in a locking engagement of locking semi-circular sector 232 with locking notch 72 of shackle arm 71. This mechanism prevents shackle 70 from slipping out. In the meantime, the locking spring catch 612 also moves toward locking spring 80 which will be caught by locking spring catch 612 by means of a releasing force, ensuring that the locking core member 60 will not move back to its original unlocking position by a releasing force of axial spring 50. When a key is inserted into a key hole 621 and turned, as shown in FIG. 4, the rotation of locking core member 60 will cause sectored disk 40 to turn in one direction for only 90 degrees, due to the fact that the receiving block 30 obstructs the movement of cam sectors 42 of sectored disk 40. In addition, the locking core member 60 and the locking spring catch 612 of rotating bolt 61 will turn simultaneously, causing locking spring 80 to be released and axial spring 50 force out the locking core member 60 to its original unlocked position and thus permitting the key to be removed from the key hole 621. For the reasons stated above, a padlock of this invention provides not only convenience of ease of use but also reliability.

In addition, the shackle arms 71 of U-shaped shackle 70 can be pushed into the shackle receiving holes 14 of the lock body 10 and circular sectors 231 of locking plate 20 respectively without difficultly. As shown in FIGS. 2 and 3, that receiving block 30 and lock body 10 are attached firmly together as an integral body and that front end plate 22 of locking plate 20 as well as locking core member 60 are confined to guiding groove 32 of receiving block 30 and sliding groove 622, respectively.

It is also worthwhile to mention that the locking notches 72 of shackles can be easily pressed into shackle receiving holes 14 to engage in a locking mechanism and that a key is not needed when locking core member 60 is pushed in to have the padlock locked.

It can be now concluded that a simple, fast, and burglar-proof locking mechanism of a padlock can be achieved by pushing in a structural component such as locking core member and that a fast unlocking mechanism of a padlock can be also obtained by turning the locking core member in one direction through 90 degrees. The locking and unlocking mechanisms of a application of improved locking structures of simple construction which have neither been discussed in any published literature nor made available in the market place today. In short, this invention has achieved three important objectives of practicality, novelty, and progressiveness. For this reason, this inventor has decided to apply for a patent of a padlock referred to in this invention report. Your favorable consideration on this application will be greatly appreciated by this inventor.

I claim:

1. An improved locking structure of a padlock, comprising:

a lock body, being hollow and cylindrical in shape, having an opening at front end thereof and two shackle receiving holes located at appropriate positions thereof to receive shackle arms which have locking notches located at end portions thereof; a locking plate manufactured in proportion to inner diameter of said lock body and assembled inside said lock body and capable of sliding axially inside said lock body and having two shackle engaging slots thereon with locking semi-circular sectors at one end thereof to facilitate a locking engagement between said locking notches and said locking semi-circular sectors;

a receiving block, which is assembled firmly inside said lock body, being semi-circular on other end thereof with axial pin recess therein and a semi-circular retaining groove thereon to facilitate a locking spring;

a sectored disk, assembled between said locking plate and receiving block, having a cam sector thereon and an oval hole thereinto;

an axial spring resisting the circular cross-sectional end of said receiving block, and;

a locking core member, capable of sliding axially inside said lock body for an appropriate distance, having on one side thereof a rotating bolt whose one end is firmly assembled with said locking plate and sectored disk, and having on other side thereof a locking head with a key hole thereinto and a sliding groove therein of an appropriate length;

therefore, without using a key to drive said locking core member of a padlock, it is possible to achieve a speedy and ensuring locking mechanism by employing integral structures mentioned above and by simply pushing said U-shaped shackle arms into said shackle engaging slots of said locking plate and then pushing in said locking core member, causing said locking spring to be engaged with locking spring catch in order to refrain said locking core member from moving about and in the meantime driving said locking plate to slide axially in order to cause said locking semi-circular sectors to be in an engaging position with said locking notches of said shackle arms.

* * * * *